United States Patent [19]

Vivier

[11] Patent Number: 4,515,689

[45] Date of Patent: May 7, 1985

[54] CLASSIFYING MEANS

[75] Inventor: Jacobus L. Vivier, Verkeerdevlei, South Africa

[73] Assignee: Clasicon (Proprietary) Limited, Bloemfontein, South Africa

[21] Appl. No.: 557,545

[22] Filed: Dec. 2, 1983

[30] Foreign Application Priority Data

Dec. 3, 1982 [ZA] South Africa ..... 82/8920

[51] Int. Cl.[3] ..... B03B 5/58; B04B 1/10

[52] U.S. Cl. ..... 209/453; 209/505

[58] Field of Search ..... 209/361, 450–453, 209/503, 505

[56] References Cited

U.S. PATENT DOCUMENTS

| | | | |
|---|---|---|---|
| 3,347,376 | 10/1967 | Johnston | 209/453 X |
| 4,286,748 | 9/1981 | Bailey | 209/453 X |
| 4,361,480 | 11/1982 | Corbus et al. | 209/453 |

FOREIGN PATENT DOCUMENTS

| | | | |
|---|---|---|---|
| 78892 | 4/1950 | Czechoslovakia | 209/361 |
| 1313753 | 4/1973 | United Kingdom | 209/453 |
| 429035 | 5/1935 | United Kingdom . | |
| 567959 | 3/1944 | United Kingdom . | |
| 666781 | 2/1952 | United Kingdom . | |
| 780931 | 8/1957 | United Kingdom . | |
| 884284 | 12/1961 | United Kingdom . | |
| 1036543 | 7/1966 | United Kingdom . | |
| 1134864 | 11/1968 | United Kingdom . | |
| 1465311 | 2/1977 | United Kingdom . | |

*Primary Examiner*—Robert Spitzer

*Attorney, Agent, or Firm*—Bernard, Rothwell & Brown

[57] ABSTRACT

A centrifugal classification apparatus for separating particulate solids, such as sand, in a fluid mixture into fractions having common physical characteristics, such as particle size and/or weight. The apparatus includes a frusto-conical hollow shell rotatable about a longitudinal rotation axis and having an inlet opening at one end for receiving the fluid mixture and an outlet opening at its other end; a discharge aperture in the shell between its inlet and outlet openings through which the solids may pass; and a collecting compartment fast with the shell and located about the discharge aperture for collecting a fraction of the solids having common physical characteristics. The compartment extends radially outwardly from the shell and has a radial depth greater than the maximum longitudinal width of the aperture, a closable discharge orifice at its radially outer end; and a valve at the orifice for controlling discharge of solids from the compartment. The apparatus also has a flushing means for introducing a counter-current flushing fluid into the collecting compartment between its discharge orifice and the aperture. A further embodiment of the apparatus includes a weir projecting circumferentially from the shell and located between the inlet and outlet openings. In addition, the aperture is divided into two apertures by a circumferential splitting member spanning the aperture.

25 Claims, 5 Drawing Figures

CLASSIFYING MEANS

This invention relates to a classification apparatus. More particularly, it relates to a method and apparatus for classifying or separating a mixture of particulate solids in a fluid mixture with a carrier fluid into fractions having common physical characteristics.

According to the invention there is provided a centrifugal classification apparatus for separating particulate solids in a fluid mixture into fractions having common physical characteristics, the apparatus including an open-ended hollow shell rotatable about a longitudinal rotation axis and having an inlet opening at one axial end for receiving the fluid mixture to be separated, an outlet opening at its other axial end, and a wall extending between the inlet opening and the outlet opening;

a discharge aperture in the shell intermediate its inlet and outlet openings through which the solids may pass;

a collecting compartment fast with the shell and located about the discharge aperture for collecting a fraction of the solids having common physical characteristics, the compartment extending radially outwardly from the shell and having a radial depth greater than the maximum longitudinal width of the aperture and a closable discharge orifice at its radially outer end;

a flow causing means for causing fluid mixture fed into the shell at its inlet opening to flow along the wall of the shell towards and past the discharge aperture and towards the outlet opening;

a valve at the orifice for controlling discharge of solids from the compartment; and a flushing means for introducing a counter-current flushing fluid into the collecting compartment between its discharge orifice and the aperture.

Further according to this aspect of the invention there is provided a method of classifying a fluid mixture containing particulate solids in a carrier fluid, into fractions having common physical characteristics, the method including the steps of:

providing and rotating a shell about a rotational axis, the shell having an inlet opening at one axial end and an outlet opening at its other axial end, a wall extending between the inlet opening and the outlet opening, a discharge aperture in the wall intermediate the inlet and outlet openings, and a collecting compartment fast with the shell and located about the discharge aperture, the compartment extending radially outwardly from the shell and having a radial depth greater than the maximum longitudinal width of the aperture and having a closable discharge orifice at its radially outer end;

feeding the fluid mixture into the shell through the inlet opening and causing it to flow towards the other end of the shell and towards and past the discharge aperture, this flow being along the inner surface of the wall due to centrifugal force exerted on the mixture by the rotation of the shell, a certain portion of the mixture entering the compartment and thereby filling it, such that further mixture fed into the shell through the inlet opening tends to flow towards and past the aperture with that fraction of the constituents having the same characteristics settling out of the flow into the compartment;

feeding a counter-current fluid into the compartment intermediate its radially inner end adjacent the shell and its orifice; and periodically opening the orifice when a sufficient quantity of the solids has settled in the compartment, thereby to discharge all or part of the settled solids.

According to a further aspect of the invention there is provided a centrifugal classification apparatus for separating particulate solids in a fluid mixture into fractions having common physical characteristics, the apparatus including an open-ended hollow shell rotatable about a longitudinal rotation axis and having an inlet opening at one axial end for receiving the fluid mixture to be separated, an outlet opening at its other axial end, and a wall extending between the inlet opening and the outlet opening;

a discharge aperture in the shell intermediate its inlet and outlet openings through which the solids may pass;

a collecting compartment fast with the shell and located about the discharge aperture for collecting a fraction of the solids having common physical characteristics, the compartment extending radially outwardly from the shell and having a radial depth greater than the maximum longitudinal width of the aperture and a closable discharge orifice at its radially outer end;

a flow causing means for causing fluid mixture fed into the shell at its inlet opening to flow along the wall of the shell towards and past the discharge aperture and towards the outlet opening;

a valve at the orifice for controlling discharge of solids from the compartment; and a circumferentially extending weir fast with the wall, projecting into the shell and located between the inlet opening and the discharge aperture.

According to a still further aspect of the invention there is provided a centrifugal classification apparatus for separating particulate solids in a fluid mixture into fractions having common physical characteristics, the apparatus including an open-ended hollow shell rotatable about a longitudinal rotation axis and having an inlet opening at one end for receiving the fluid mixture to be separated, an outlet opening at its other axial end, and a wall extending between the inlet opening and the outlet opening;

a discharge aperture in the shell intermediate its inlet and outlet openings through which the solids may pass;

a collecting compartment fast with the shell and located about the discharge aperture for collecting a fraction of the solids having common physical characteristics, the compartment extending radially outwardly from the shell and having a radial depth greater than the maximum longitudinal width of the aperture and a closable discharge orifice at its radially outer end;

a flow causing means for causing fluid mixture fed into the shell at is inlet opening to flow along the wall of the shell towards and past the discharge aperture and towards the outlet opening;

a valve at the orifice for controlling discharge of solids from the compartment; and a splitting member extending circumferentially across the discharge aperture and projecting inwardly from the wall of the shell, so that the aperture is divided into an upstream aperture, longitudinally closer to the inlet opening, and a downstream aperture, longitudinally closer to the outlet opening.

In use, the shell is mounted with its rotational axis in an upwardly extending plane, the rotational axis preferably extending substantially vertically, with the inlet opening of the shell lowermost and the outlet opening uppermost.

The flow causing means may be a specific component such as a pump with suitable conduits, or it may result from the arrangement and shape of the shell. Thus the shell may diverge from its inlet opening to its outlet opening, such that upon rotation thereof material therewithin experiences forces that cause it to move along the wall.

The collecting compartment may converge from its inner end adjacent the shell to the orifice at its radially outer end.

The apparatus may have a flow regulating means for regulating circumferential flow of material within and relative to the shell. Thus the flow regulating means may impede relative movement between material within the shell and the shell, in a circumferential direction, thereby causing the material to rotate with the shell. The flow regulating means may be provided by fins which are fast with the wall of the shell, extend longitudinally and project into the shell. Preferably a plurality of fins are provided, so that the inner surface of the shell is divided into a plurality of channels extending longitudinally between the fins from the inlet to the outlet opening of the shell. The fins may thus extend continuously between the inlet opening and the outlet opening. The channels may be defined between opposing surfaces of the fins.

The apparatus may have a number of discharge apertures which are located in these channels and which are at the same longitudinal distance from the inlet opening, a suitable number of compartments then being provided. There may be one compartment for each aperture, or one compartment may be served by several apertures.

In use, due to rotation of the shell, one of the surfaces of each fin will lead and the other will trail, so that these surfaces are referred to below as the leading surface and trailing surface respectively of each fin.

Each channel may also have a weir. Each weir may then extend from one fin to the other, ie across the channel defined by the fins. Preferably, each weir projects further into the shell at or adjacent to the leading surface of a fin, ie each weir narrows progressively from the leading surface of one fin to the trailing surface of the other fin between which it is located. However, there may be instances in which it is preferable to have each weir extend further into the shell on the trailing surface of the fin forming one side of the channel.

Each aperture preferably has its own splitting member. The splitting members may also project, at least partially, into the collecting compartments. The splitting members are typically of substantially planar sheet material and may extend between opposing surfaces of pairs of fins.

The discharge apertures may also be longitudinally partitioned to divide each upstream aperture into a leading upstream aperture and a trailing upstream aperture, and each downstream aperture into a leading downstream aperture and a trailing downstream aperture.

The leading upstream aperture may be closed off by a blocking member. Likewise, the trailing downstream aperture may be at least partially closed off by a longitudinally directed flange extending downstream from the splitting member at an angle thereto. The flange is preferably at right angles to the splitting member and extends from an edge thereof which projects into the shell. Thus, the flange is typically parallel to the wall of the shell and spaced inwardly therefrom.

Each splitting member may project further into the shell at its leading end than at its trailing end. However, each splitting member may project further into its associated compartment at its trailing end than at its leading end.

Thus, in use, fluid mixture bearing particulate solids to be separated, flows over the discharge apertures in the direction of the outlet opening of the shell. A portion of the fluid mixture containing predominantly larger or heavier particles passes into the collecting compartments via the trailing upstream apertures. The larger or heavier particles tend to settle out in the collecting compartments whereas lighter and/or smaller particles tend to be discharged from the compartments via the leading downstream apertures without settling. This selective settling process is further enhanced by the effect of the flushing fluid which flows counter-current from the compartments into the shell and thereby flushes lighter and/or smaller particles back into the shell.

The invention will now be described, by way of an example, with reference to the accompanying drawings.

In the drawings

Figure 1:
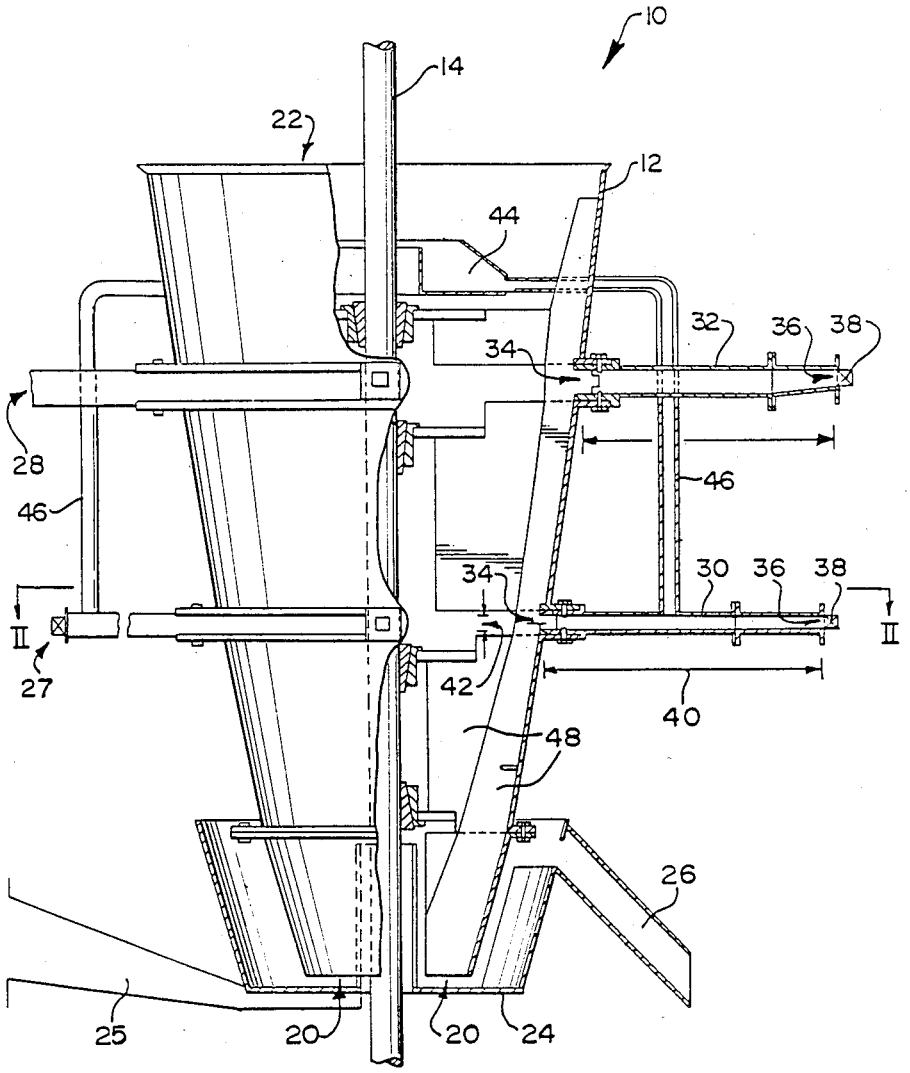
FIG. 1 shows a partly sectioned view of a classifying apparatus in accordance with the invention.
Figure 2:
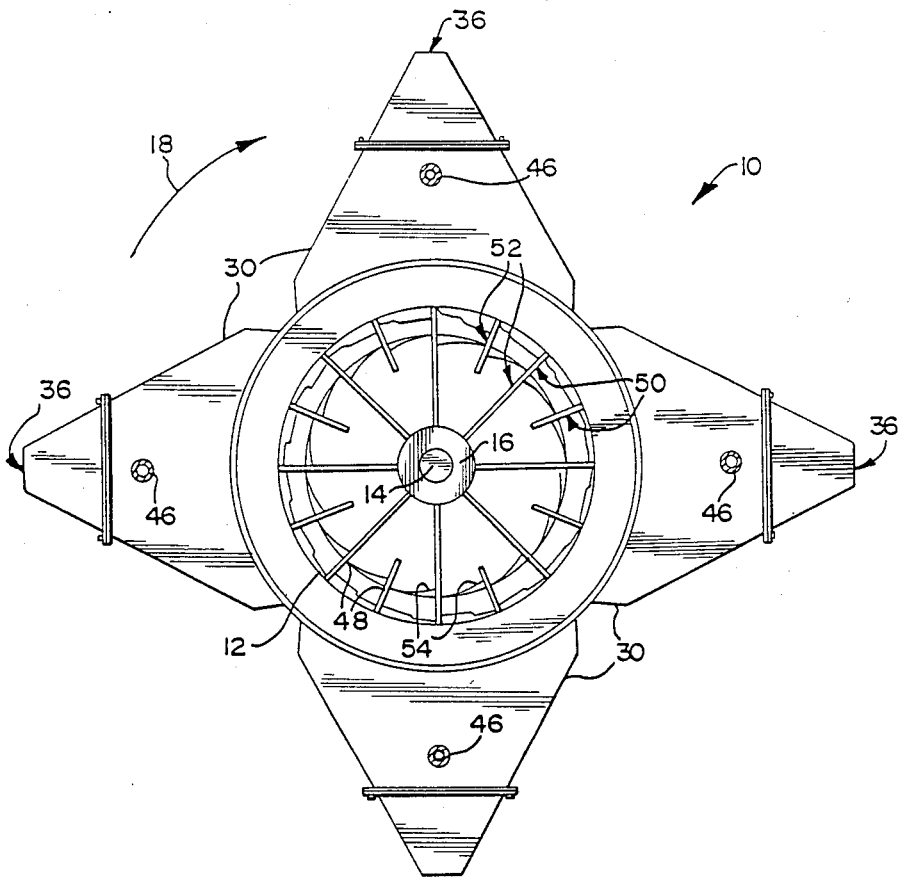
FIG. 2 shows a sectioned plan view of the apparatus taken along line II—II in FIG. 1.

With reference to FIGS. 1 and 2, an apparatus for classifying a particulate solid, such as sand, from a mixture thereof in a carrier fluid, such as water, is designated generally by reference numeral 10. The apparatus 10 comprises a frusto-conical shell 12 which is attached to a shaft 14, which in turn is provided with a connection disc 16 whereby the shell is connected thereto, as described below. The shaft 14 is vertically mounted and is also rotatable as indicated by arrow 18 in FIG. 2. At its lower end, the shell 12 has an inlet opening 20 and at its upper end it has an outlet opening 22.

Located about the bottom end of the shell 12 is a feed trough 24. The trough 24 has an inlet duct 25 and an overflow outlet duct 26.

The apparatus 10 further has two banks 27, 28 of collecting compartments. Each of the banks 27, 28 comprises four settling compartments, the compartments of each bank being designated respectively by reference numerals 30 and 32. The compartments 30, 32 are fast with the shell 12 about discharge apertures 34 provided in the shell 12. Each of the compartments 30, 32 converges from its entrance (located about the aperture 34) towards a closable orifice 36 at is radially outer end. Each orifice 36 is closed by a valve 38. As is clearly shown in FIG. 1, each compartment 30, 32 has a radial depth 40 which is greater than the maximum longitudinal width 42 of its entrance, ie the discharge aperture 34.

A further feed trough 44 is provided fast with the shaft 14 and is rotated therewith. The trough 44 communicates with each of the compartments 30 by means of feed pipes 46 entering the compartments 30 between their orifices 36 and their entrances at the apertures 34.

The apparatus 10 has sixteen longitudinally extending fins 48 which are attached to the inner surface of the shell 12 and project inwardly towards the shaft 14. The fins 28 extend continuously from the inlet opening 20 to the outlet opening 22. Every alternate fin 48 is attached to the shaft 14 by means of the discs 16.

It will be appreciated, that due to rotation of the shell 12 in the direction 18, each fin 48 will have a leading surface 50 and a trailing surface 52. The fins 48 cause water and sand mixture contained in the feed trough 24 and such mixture within the shell 12 to rotate together with the shell 12. Under the influence of force the mixture then moves upwardly, along the inner surface of the shell 12 towards the outlet opening 22.

Positioned between the first bank 27 of the compartments 30 and the inlet opening 20, a number of weirs 54 which extend circumferentially between adjacent fins 48 and project into the shell 12. As is seen in FIG. 2, the weirs 54 project further into the shell at their trailing edges. Thus, a weir 54 is provided between each pair of fins 48.

Figure 3:
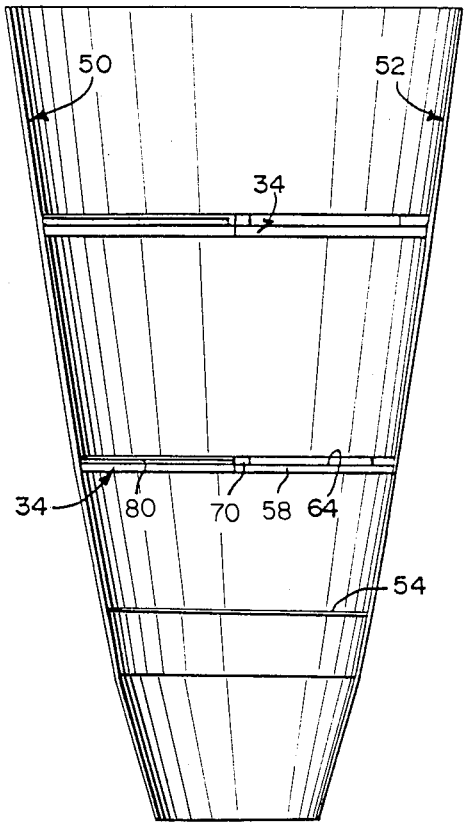
FIG. 3 shows a developed view (not to scale) of a segment of the classifying apparatus.

As can be seen in FIG. 3, each discharge aperture 34, ie the entrance to each compartment 30, is provided with a splitting member 56 and a blocking member 58. These members are shown in more detail in FIGS. 4 and 5.

Figure 4:
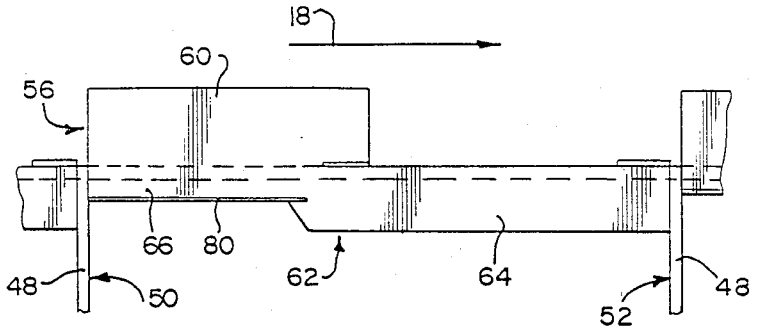
FIG. 4 shows a plan view of a discharge aperture, in a wall portion of the apparatus, including a splitting member and a blocking member.

Each splitting member 56 is located in its associated aperture 34 and extends circumferentially across it from one fin 48 to the other. The splitting members 56 thus divide the apertures 34 into upstream apertures on the side of the inlet opening 20, and downstream apertures on the other side, ie on the side of the outlet opening 22. Furthermore, the splitting members 56 have one part 60 projecting into the compartments 30 and another part 62 projecting into the shell 12. As can be seen in FIG. 4, the parts 60 extend only about half-way, whereas the parts 62 extend completely across the apertures 34 from one fin 48 to another. The parts 60 are located on the trailing portions of the splitting members 56. The parts 62 vary in width along their lengths between the fins 48, each having a wider portion 64 at its portion adjacent the trailing surfaces 52 and narrower portions 66 on its portion adjacent the leading surfaces 50.

Each discharge aperture 34 is longitudinally partitioned by a centre piece 70 dividing the downstream aperture of that aperture 34 into a trailing downstream aperture 72 and a leading downstream aperture 74. A second connecting piece 76, similar to the centre piece 70 bridges the leading downstream aperture 74 adjacent the trailing surface 52 of the fin 48.

In addition, the upstream aperture is divided into a trailing upstream aperture 78, which is open, and a leading upstream aperture whih is closed off by the blocking member 58 which extends across the upstream aperture between the splitting member 56 and the wall of the shell 12.

Figure 5:
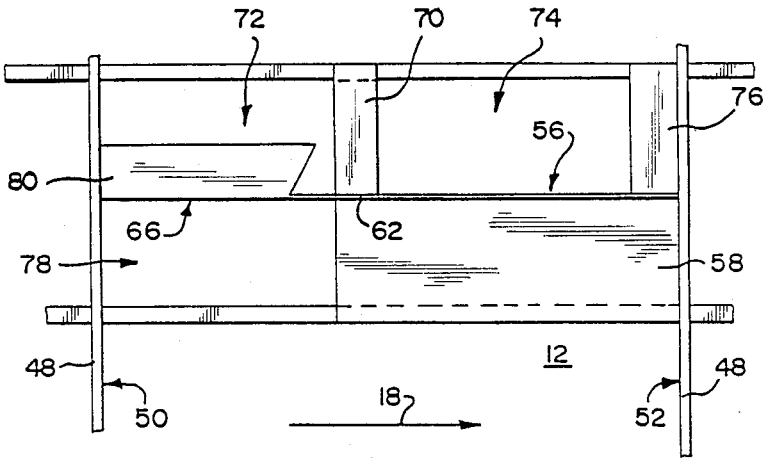
FIG. 5 shows an enlarged view of the discharge aperture, with the splitting member and blocking member.

Each trailing downstream aperture 72 is partially closed off by an upwardly directed flange 80 extending partially across the said aperture 72 from the inner end of the narrower portion 66 of its splitting member 56, as can be seen from FIGS. 4 and 5.

In use, a mixture of sand and water is fed into the trough 24. The shell 12 is rotated, causing the mixture to be fed into the shell 12 at its inlet opening 20 and to flow along the inner surface of the shell 12 towards the outlet opening 22. Initially, the water and sand mixture flows into the compartments 30 and 32 until they are filled. Thereafter, further mixture is caused to flow towards and past the dischage apertures 34. As the mixture flows along the inner surface of the shell 12, a certain amount of stratification results, so that the larger and heavier particles or grains of sand migrate within the mixture and tend to congregate in a layer adjacent the inner surface of the shell 12. The particle size and mass of the grains of sand within the mixture become progressively smaller towards the interior of the shell 12.

The Applicant has found that the weirs 54 tend to improve the stratification process, so that by the time the mixture reaches the first bank 26 of compartments 30, substantial stratification has taken place. As the mixture then passes towards and past the apertures 34, the larger and heavier particles pass into the compartment 30 and settle out at the radial extremities thereof, the initial "unclassified" contents of the compartments 30 and 32 having been exhausted and returned to the feed trough 24 for classification.

The Applicant has further found that the splitting members 56 tend to improve the settling process within the compartments 30. Further, as the splitting members 56 split the apertures 34 into upstream and downstream apertures, material of the mixture tends to flow into each of the compartments 30 through their trailing upstream apertures 78 and out of the compartments 30 through their downstream apertures 72 and 74. In this way, turbulence within the mouths of the compartments 30 is minimised and settling of the larger and/or heavier particles of sand is promoted.

It will further be understood, that with rotation of the shell 12, the heavier and/or larger particles of sand tend to concentrate on the leading surfaces 50 of the fins 48. As the leading upstream apertures are closed off by the blocking members 58, the possibility of lighter and/or finer particles of sand entering the compartments 30 is minimised.

To further improve the efficiency of the apparatus 10, clean water is fed into the compartments 30 from the upper feed trough 44 and via the feed pipes 46. This causes a counter-current of clean water to flow in each compartment 30 towards the discharge aperture 34 and the shell 12. The counter-current water tends to displace lighter and/or finer particles of sand within the compartments 30 and to flush those particles out of the compartments 30 into the shell 12 via the downstream apertures 72, 74.

The sand particles which pass the compartments 30 of the bank 27 are further stratified before they reach the compartments 32 of the bank 28. The remaining sand particles then flow into the compartments 32 to be collected therein. Resultant substantially clear water is then discharged from the shell 12 via the outlet opening 22.

It will be appreciated that sand particles in a fluid mixture need not necessarily be separated into only two fractions as described above. In practice, the relative longitudinal spacing between the discharge apertures 34 of successive banks of compartments, such as banks 27 and 28 mentioned above, as well as the number of such banks provided in the shell, will determine the number of fractions into which the sand can be separated.

After periodic intervals the valves 38 are opened to discharge sand particles which have collected in the compartments 30 and 32. A suitable collecting arrangement is provided (not shown in the drawings) to separately collect the sand particles discharged from the compartments 30 and from the compartments 32, and also the substantially clear water discharged from the outlet opening 22.

I claim:

1. A centrifugal classification apparatus for separating particulate solids in a fluid mixture into fractions having common physical characteristics, the apparatus including an open-ended hollow shell rotatable about a longitudinal rotation axis and having an inlet opening at one axial end for receiving the fluid mixture to be separated, an outlet opening at its other axial end, and a wall extending between the inlet opening and the outlet opening;

a discharge aperture in the shell intermediate its inlet and outlet openings through which the solids may pass;

a collecting compartment fast with the shell and located about the discharge aperture for collecting a fraction of the solids having common physical characteristics, the compartment extending radially outwardly from the shell and having a radial depth greater than the maximum longitudinal width of the aperture and a closable discharge orifice at its radially outer end;

a flow causing means for causing fluid mixture fed into the shell at its inlet opening to flow along the wall of the shell towards and past the discharge aperture and towards the outlet opening;

a valve at the orifice for controlling discharge of solids from the compartment;

a flushing means for introducing a counter-current flushing fluid into the collecting compartment between its discharge orifice and the aperture; and a splitting member extending circumferentially across the discharge aperture and projecting inwardly from the wall of the shell, so that the aperture is divided into an upstream aperture, longitudinally closer to the inlet opening, and a downstream aperture, longitudinally closer to the outlet opening.

2. An apparatus as claimed in claim 1, in which the collecting compartment converges from its inner end adjacent the shell to the orifice at its radially outer end.

3. An apparatus as claimed in claim 1, which incudes a flow regulating means for regulating circumferential flow of material within and relative to the shell.

4. An apparatus as claimed in claim 3, in which the flow regulating means is provided by inwardly projecting longitudinally extending fins fast with the wall of the shell.

5. An apparatus as claimed in claim 4, which includes an inwardly projecting weir extending circumferentially between two adjacent fins and located between the inlet opening of the shell and the discharge aperture.

6. An apparatus as claimed in claim 5, in which the radial width of the weir varies circumferentially.

7. An apparatus as claimed in claim 1, in which the splitting member projects, at least partially, into the collecting compartment.

8. An apparatus as claimed in claim 1, in which the discharge aperture is longitudinally partitioned to divide the upstream aperture into a leading upstream aperture and a trailing upstream aperture, and to divide the downstream aperture into a leading downstream aperture and a trailing downstream aperture.

9. An apparatus as claimed in claim 8, which includes a blocking member that closes off the leading upstream aperture.

10. An apparatus as claimed in claim 1 in which the shell diverges from its inlet opening to its outlet opening.

11. A centrifugal classification apparatus for separating particulate solids in a fluid mixture into fractions having common physical characteristics, the apparatus including an open-ended hollow shell rotatable about a longitudinal rotation axis and having an inlet opening at an axial end for receiving the fluid mixture to be separated, an outlet opening at its other axial end, and a wall extending between the inlet opening and the outlet opening;

a discharge aperture in the shell intermediate its inlet and outlet openings through which the solids may pass;

a collecting compartment fast with the shell and located about the discharge aperture for collecting a fraction of the solids having common physical characteristics, the compartment extending radially outwardly from the shell and having a radial depth greater than the maximum longitudinal width of the aperture and a closable discharge orifice at its radially outer end;

a flow causing means for causing fluid mixture fed into the shell at its inlet opening to flow along the wall of the shell towards and past the discharge aperture and towards the outlet opening;

a valve at the orifice for controlling discharge of solids from the compartment;

a circumferentially extending weir fast with the wall, projecting into the shell and located between the inlet opening and the discharge aperture; and a splitting member extending circumferentially across the discharge aperture and projecting inwardly from the wall of the shell, so that the aperture is divided into an upstream aperture, longitudinally closer to the inlet opening, and a downstream aperture, longitudinally closer to the outlet opening.

12. An apparatus as claimed in claim 11, in which the collecting compartment converges from its inner end adjacent the shell to the orifice at its radially outer end.

13. An apparatus as claimed in claim 11, which includes a flow regulating means for regulating circumferential flow of material within and relative to the shell.

14. An apparatus as claimed in claim 13, in which the flow regulating means is provided by inwardly projecting longitudinally extending fins fast with the wall of the shell.

15. An apparatus as claimed in claim 11, in which the radial width of the weir varies circumferentially.

16. An apparatus as claimed in claim 11, in which the splitting member projects, at least partially, into the collecting compartment.

17. An apparatus is claimed in claim 11, in which the discharge aperture is longitudinally partitioned to divide the upstream aperture into a leading upstream aperture and a trailing upstream aperture, and to divide the downstream aperture into a leading downstream aperture and a trailing downstream aperture.

18. An apparatus as claimed in claim 17, which includes a blocking member that closes off the leading upstream aperture.

19. A centrifugal classification apparatus for separating particulate solids in a fluid mixture into fractions having common physical characteristics, the apparatus including an open-ended hollow shell rotatable about a longitudinal rotation axis and having an inlet opening at one axial end for receiving the fluid mixture to be separated, an outlet opening at its other axial end, and a wall extending between the inlet opening and the outlet opening;

a discharge aperture in the shell intermediate its inlet and outlet openings through which the solids may pass;

a collecting compartment fast with the shell and located about the discharge aperture for collecting a fraction of the solids having common physical characteristics, the compartment extending radially outwardly from the shell and having a radial depth greater than the maximum longitudinal width of the aperture and a closable discharge orifice at its radially outer end;

a flow causing means for causing fluid mixture fed into the shell at its inlet opening to flow along the wall of the shell towards and past the discharge aperture and towards the outlet opening;

a valve at the orifice for controlling discharge of solids from the compartments; and a splitting member extending circumferentially across the discharge aperture and projecting inwardly from the wall of the shell, so that the aperture is divided into an upstream aperture, longitudinally closer to the inlet opening, and a downstream aperture, longitudinally closer to the outlet opening.

20. An apparatus as claimed in claim 19, in which the collecting compartment converges from its inner end adjacent the shell to the orifice at is radially outer end.

21. An apparatus as claimed in claim 19, which includes a flow regulating means for regulating circumferential flow of material within and relative to the shell.

22. An apparatus as claimed in claim 21, in which the flow regulating means is provided by inwardly projecting longitudinally extending fins fast with the wall of the shell.

23. An apparatus as claimed in claim 19, in which the splitting member projects, at least partially, into the collecting compartment.

24. An apparatus as claimed in claim 19, in which the discharge aperture is longitudinally partitioned to divide the upstream aperture into a leading upstream aperture and a trailing upstream aperture, and to divide the downstream aperture into a leading downstream aperture and a trailing downstream aperture.

25. An apparatus as claimed in claim 24, which includes a blocking member that closes off the leading upstream aperture.

* * * * *

UNITED STATES PATENT AND TRADEMARK OFFICE

CERTIFICATE OF CORRECTION

PATENT NO. : 4,515,689

DATED : May 7, 1985

INVENTOR(S) : Jacobus Lodewickus Vivier

It is certified that error appears in the above-identified patent and that said Letters Patent is hereby corrected as shown below:

Column 5, line 4, the numeral "28" should be --48--.

Column 6, line 11, the numeral "26" should be --27--.

Signed and Sealed this

*Eighth* Day of *October 1985*

[SEAL]

*Attest:*

DONALD J. QUIGG

*Attesting Officer*

*Commissioner of Patents and Trademarks—Designate*